United States Patent [19]

Kuhr

[11] Patent Number: 4,757,663

[45] Date of Patent: Jul. 19, 1988

[54] DRYWALL FURRING STRIP SYSTEM

[75] Inventor: Albert F. Kuhr, Elk Grove Village, Ill.

[73] Assignee: USG Interiors, Inc., Chicago, Ill.

[21] Appl. No.: 48,219

[22] Filed: May 11, 1987

[51] Int. Cl.[4] ..... E04B 5/52

[52] U.S. Cl. ..... 52/484; 52/488; 52/664; 52/720

[58] Field of Search ..... 52/484, 482, 488, 664, 52/666, 667, 668, 720, 721, 714, 762, 779

[56] References Cited

U.S. PATENT DOCUMENTS

| | | | |
|---|---|---|---|
| 3,287,874 | 11/1966 | Stahlhut | 52/720 |
| 3,678,641 | 7/1972 | Englund et al. | 52/484 |
| 3,928,954 | 12/1975 | Naude | 52/664 |
| 4,245,446 | 1/1981 | Judkins | 52/484 X |
| 4,364,215 | 12/1982 | Gailey et al. | 52/488 |

*Primary Examiner*—J. Karl Bell

*Attorney, Agent, or Firm*—Robert M. Didrick; Robert H. Robinson

[57] ABSTRACT

A drywall furring system comprises a plurality of longitudinal carrying channels having congruent tongues co-planar with, spaced apart along and depending from the opposite flanges of the channels and a plurality of furring channels having pairs of slots spaced apart along the opposite flanges thereof. On opposite edges of the tongues there are tabs tapering upwardly from the rounded corners thereof and elongated, narrow fingers whose lower margins angle up from a point space apart from the distal edges of the tongues. The tabs and fingers have seats in the same horizontal plane and the fingers have retaining hooks extending up beyond the seats. A gridwork of the carrying channels and furring channels is constructed by aligning opposed congruent fingers of the former with a pair of slots in the latter and passing the fingers through the slots and pushing the opposite flanges of the furring channel over the rounded corners of the tongues so that the furring strips rest on the seats of the fingers and tabs. Gypsum wallboard is attached to the furring strips to form a ceiling. A linear metal ceiling or wall may be constructed by using furring strips having a decorative web to fashion the exterior surface.

8 Claims, 3 Drawing Sheets

DRYWALL FURRING STRIP SYSTEM

This invention relates to a furring system for ceilings, floors and walls comprising drywall panels such as gypsum wallboard, plywood, metal slats, cement boards, and the like. The invention relates particularly to a carrying channel and a drywall furring channel which interlock simply and are easily unlocked. More particularly, the invention relates to a system for installing a suspended drywall ceiling.

Currently available drywall ceiling systems are rather cumbersome to install. Systems in which the components are tied or clipped together, such as the combination of a channel shaped carrier and hat shaped furring strip, require extra time and an extra part and, in the former case, a certain degree of wire tying skill. Inverted-T runner grids for suspending drywall ceilings are difficult to assemble and, when necessary, to take apart.

It is an object of this invention, therefore, to provide a low cost drywall furring system that is simple to install and structurally strong.

It is another object of this invention to provide a suspended drywall ceiling in which a furring channel is snapped onto a suspended carrying channel but remains in place when unsnapped.

It is another object of this invention to provide a drywall furring system wherein the flanges of a furring channel are interlocked with a carrying channel but remain flexible enough to be disengaged quickly when desired.

It is still an another object of this invention to provide a self-aligning grid system for a suspended drywall ceiling which virtually squares itself.

It is another object of this invention to provide a drywall furring system adapted to the quick and easy installation of soffits, coves, ceilings having various levels, and other complicated ceiling structures.

It is a further object of this invention to provide a partition comprising studs made from back to back pairs of the carrying channels of this invention and furring channels hung on each.

These and other objects which will become apparent are achieved by the drywall furring system of this invention which provides a strong framework of interlocking channels for ceilings, floors and walls lined with drywall panels such as gypsum or cement boards or the like, as mentioned above, all of which are included within the meaning of drywall as used herein. The system, the apparatus, the framework and the method of this invention are illustrated in the attached drawings and described hereinbelow with reference to the drawings.

IN THE DRAWINGS

Figure 1:
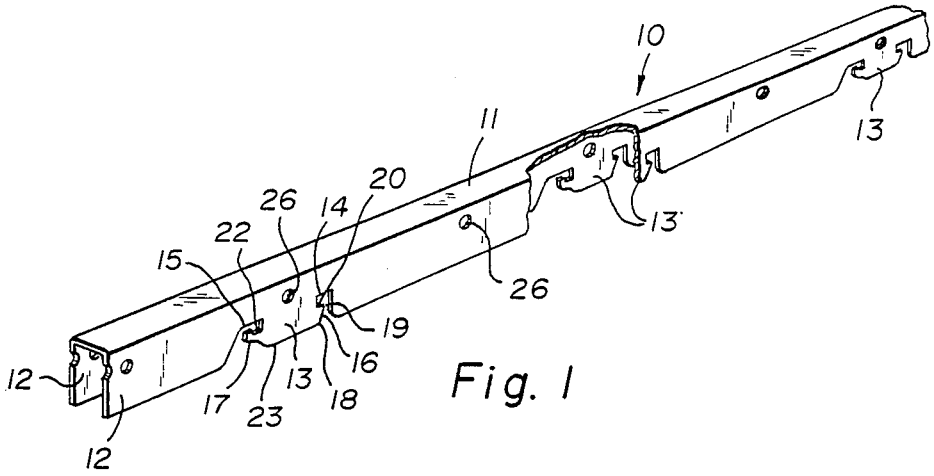
FIG. 1 is a perspective view, partially broken away, of the carrying channel of this invention.
Figure 2:
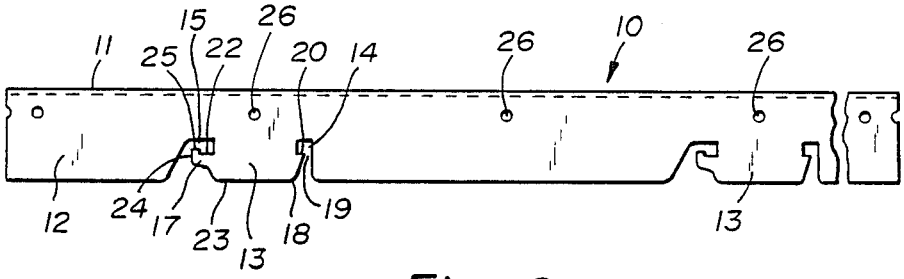
FIG. 2 is a side elevation of the carrying channel of FIG. 1.

In FIG. 1, the carrying channel 10 comprises the longitudinal web 11 and the flanges 12, which depend at right angles from opposite edges of the web. Arrayed in transverse opposition to one another along the length of each flange 12 are a plurality of the tongues 13, which are integral, co-planar segments of each flange but are set apart therefrom by the irregular notches 14 and 15. On opposite edges of each tongue 13 and co-planar therewith are the tab 16 and the finger 17, as shown in FIG. 2, the tab tapering upwardly from the rounded corner 18 of the tongue into a notch 14 to form the restricted passage 19 and then receding horizontally to form the seat 20. Compared to the tab 16, the finger 17 is an elongated, narrow body; it does not have the depth of the tab 16. The seat 22 of the finger is in the same horizontal plane as the seat 20 of the opposing tab but the lower margin of the finger 17 angles up toward the web 11 from a point spaced apart from the distal edge 23 of the tongue 13. The tip 24 of the finger 17 extends above the seat 22 to provide the retaining hook 25. The holes 26 for support wires in each tongue 13 may be midway between the tab 16 and the finger 17 and also between the tongues.

Figure 3:
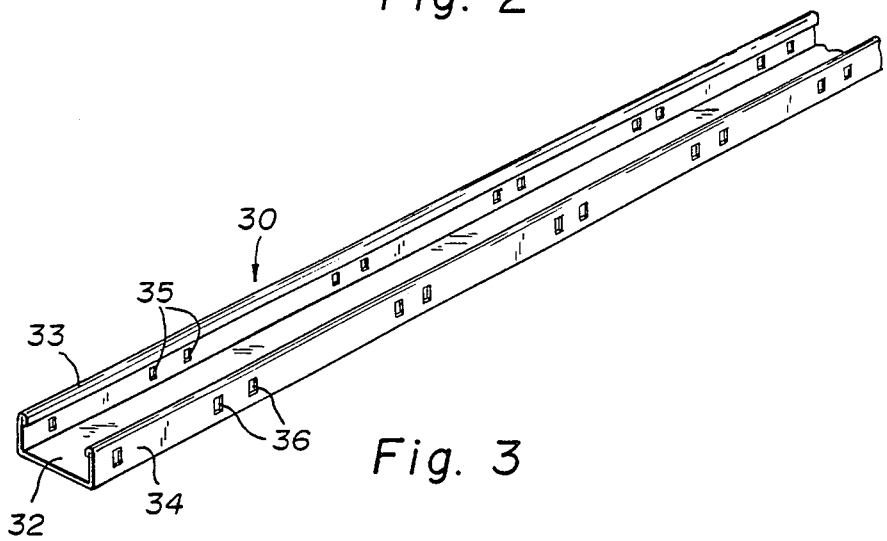
FIG. 3 is a perspective view of the furring channel of this invention.

In FIG. 3, the furring channel 30 comprises the web 32 and the flanges 33 and 34, which extend at right angles from opposite edges of the web 32. Arrayed along the flanges 33 and 34 and in transverse alignment with one another are the paired slots 35 and 36, respectively. The distance between the slots of each pair is substantially equal to the width of the web 11 of the carrying channel 10. The web 32 may be plated, polished or painted to convert the furring channel into a decorative metal panel. Widening of the web to overhang the flanges is also contemplated. Thus, a linear metal ceiling may be constructed easily according to this invention.

Figure 4:
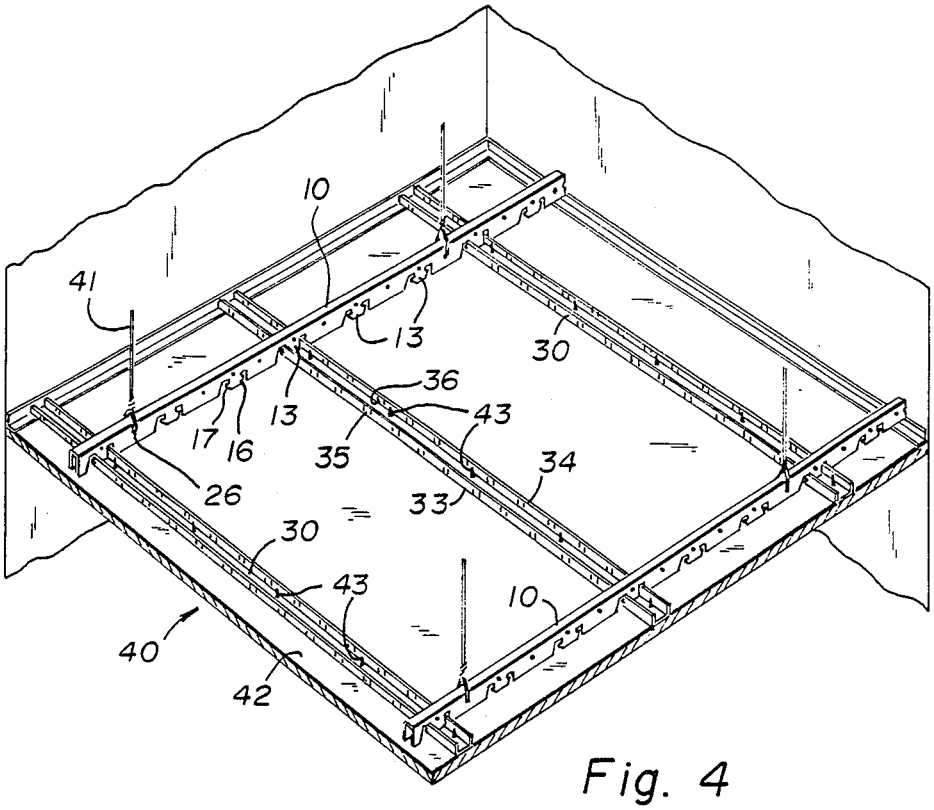
FIG. 4 is a fragmentary perspective view of the upper side of the drywall ceiling system of this invention.

In FIG. 4, the ceiling 40 is supported by the wires 41, which pass through the holes 26 of the carrying channels 10 and are secured to a structural element above the ceiling. The furring channels 30 are hung from the congruent tongues 13 of the carrying channels by passing the fingers 17 of the transversely opposed pairs of congruent tongues 13 through the appropriate pairs of slots 35 along the full length of each furring channel, pushing the flange 34 over the rounded corners 18 of the tongues and snapping the tabs 16 into the slots 36 of the furring channel. The depth of the flanges 33 and 34 of the furring channel and the depth of the tongues 13 are substantially equal so that the tongues extend fully into and nest within the furring channel. The gridwork of channels 10 and 30 may be stabilized against lateral movement by fastening the channels 10 to a perimeter wall with brackets and screws, as will be readily understood by artisans having an interest in this invention. The gypsum wallboards 42 are attached to the furring channels 30 with the screws 43. A saving of about 30% or more in installation time may be realized with this system as compared to the hat channel system.

A soffit or a false ceiling built according to this invention may be taken apart easily when it is no longer wanted. After removal of the wallboards 42, the flange 34 of a furring channel 30 is flexed outward so that the seats 20 of the tabs 16 are free of the slots 36. The full length of an 8 foot long or longer furring channel 30 may be freed from the tabs while the channel remains supported by the seats 22 until it is lifted over the retaining hooks 25. Removal of the carrying channels 10 and the wires 41 leaves the space open for a new arrangement.

Figure 5:
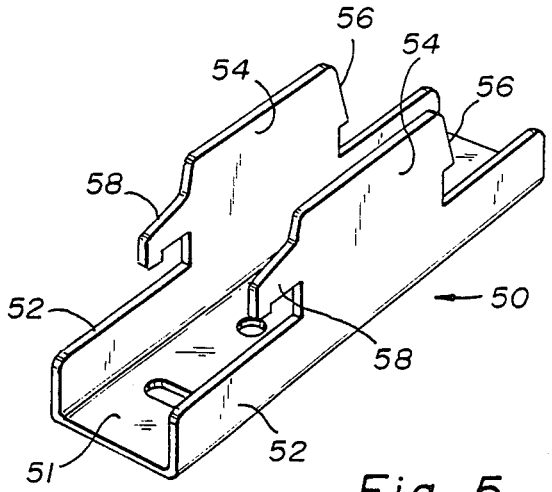
FIG. 5 is a perspective view of another carrying channel of this invention.

Another embodiment of this invention is shown in FIG. 5, wherein the carrying channel 50 comprises the web 51, the flanges 52 extending at right angles from opposite edges of the web, the tongues 54, the tabs 56, and the fingers 58. In essence, the channel 50 is a unit segment of the channel 10 described above with shortened flanges.

Figure 6:
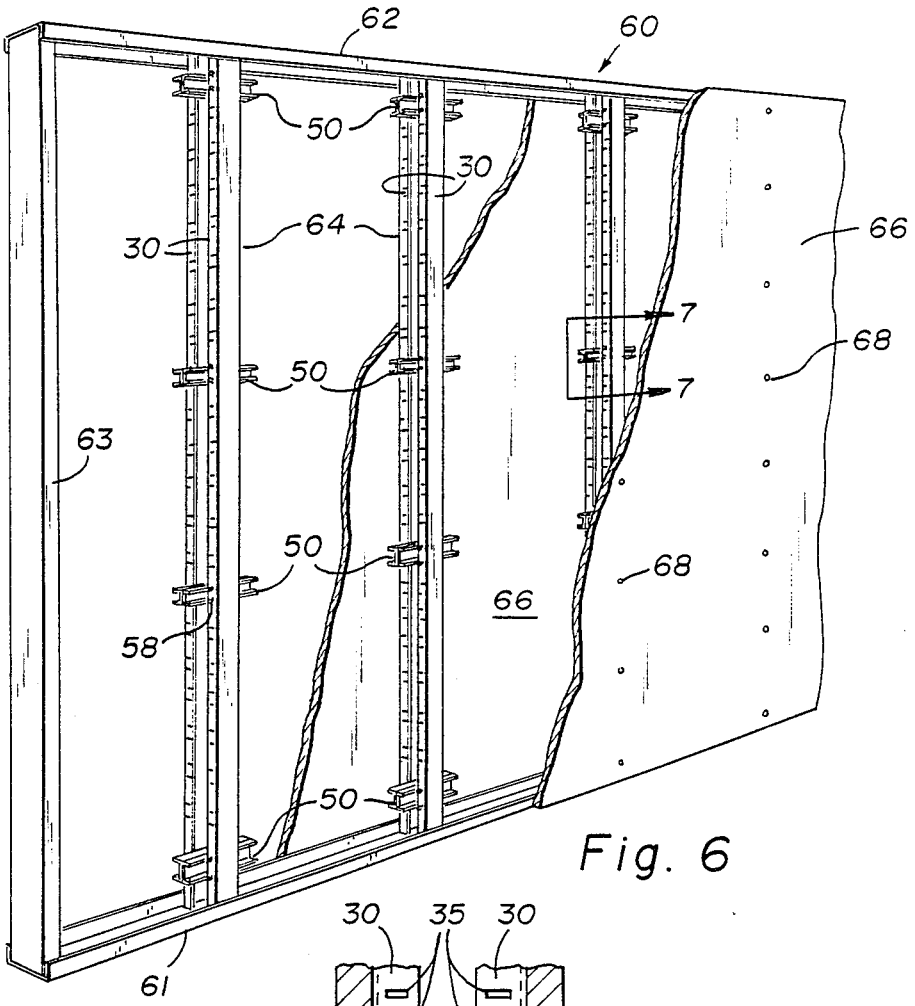
FIG. 6 is a perspective view of a partition system employing the carrying channel of FIG. 5.
Figure 7:
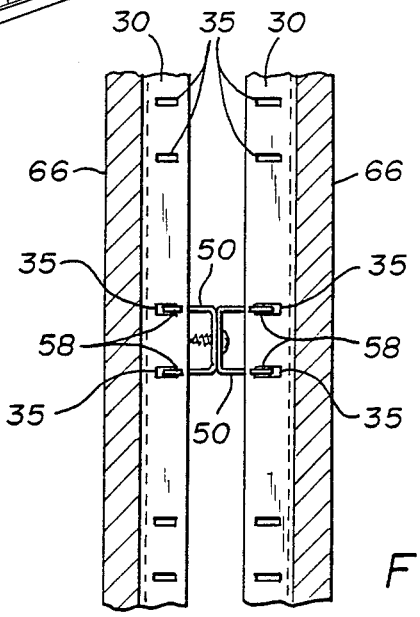
FIG. 7 is a sectional view of the partition of FIG. 6 taken along the line 7—7.

In FIG. 6, the partition 60 is built by connecting the floor runner 61 and the ceiling runner 62 with the end studs 63 and the intermediate studs 64, and attaching the wallboard 66 to the resulting framework. The intermediate studs 64 comprise eight carrying channels 50, paired off back to back, the pairs spaced apart vertically and connected by the two parallel furring channels 30 which are hung on the hooks 58 of the opposing channels 50 of each pair, as shown in FIG. 7. The slots 36 of the channel 30 are snapped over the tabs 56 (not shown) of the carrying channel. The webs 51 of the back-to-back channels 50 may be separated by acoustical pads, if desired. The wallboard 66 may be attached to the studs 63 and 64 and to the runners 61 and 62 by the screws 68 or an adhesive.

The subject matter claimed is:

1. A structural unit in a building comprising a plurality of carrying channels and a plurality of furring channels attached to said carrying channels attached to said carrying channels at right angles, and means for supporting said unit in the building;

each carrying channel comprising a web and a pair of substantially congruent tongues extending from opposite edges of the web, the distal edge of each tongue being parallel to the web, each tongue having a tab and an elongate finger, the edge of the tab tapering away from the distal edge toward the web and having a recessed seat substantially parallel to the web, the finger projecting from the edge of the tongue opposite the tab in generally parallel but spaced apart relationship with the distal edge, the finger having a retaining hook projecting toward the web and a seat in line with the recessed seat on the tab;

each furring channel having a web and a pair of flanges extending from opposite edges of the web, the flanges having transversely aligned pairs of slots therein, the slots of each pair being spaced apart in alignment with the paired tongues on the carrying channel which extend into the furring channel, the fingers projecting through a pair of slots in one flange, and the tabs protruding through a pair of slots in the other flange.

2. The structural unit of claim 1 wherein the carrying channel further comprises a pair of congruent flanges extending from opposite edges of the web, the tongues being integral, co-planar segments of the flanges but set apart therefrom by notches in the flanges.

3. The structural unit of claim 1 wherein the carrying channel further comprises a pair of congruent flanges extending from opposite edges of the web, the tongues being integral and co-planar with the flanges but extending beyond the flanges.

4. The structural unit of claim 1 further characterized by a gridwork of interlocking carrying channels and furring channels.

5. The structural unit of claim 4 wherein the gridwork is suspended in a horizontal plane by wires attached to the building.

6. The structural unit of claim 3 wherein the carrying channels have but one pair of congruent tongues and are paired off back to back with the tongues projecting oppositely into furring channels whose webs face away from one another.

7. The unit of claim 5 further characterized by a drywall panel attached to the webs of the furring channels.

8. The unit of claim 6 further characterized by a drywall panel attached to the webs of the furring channels.

* * * * *